US009093798B2

(12) United States Patent
Locker et al.

(10) Patent No.: US 9,093,798 B2
(45) Date of Patent: Jul. 28, 2015

(54) COMBINATION POWER AND DATA CONNECTOR

(71) Applicant: Lenovo (Singapore) Pte. Ltd., Singapore (SG)

(72) Inventors: Howard Locker, Cary, NC (US); Daryl Cromer, Cary, NC (US); Joseph Michael Pennisi, Apex, NC (US); Richard Wayne Cheston, Pittsboro, NC (US); David William Higgins, Cary, NC (US); Thomas Kenneth Tobul, Jr., Holly Springs, NC (US); Jon Wayne Heim, Durham, NC (US); Qihua Xiao, Xinyang (CN); DeHong Meng, Shanghai (CN); Zhigang Na, Beijing (CN); Zhang Jianhui, Beijing (CN)

(73) Assignee: Lenovo (Singapore) Pte. Ltd., Singapore (SG)

( * ) Notice: Subject to any disclaimer, the term of this patent is extended or adjusted under 35 U.S.C. 154(b) by 46 days.

(21) Appl. No.: 13/734,360

(22) Filed: Jan. 4, 2013

(65) Prior Publication Data

US 2014/0194008 A1 Jul. 10, 2014

(51) Int. Cl.
*H01R 27/02* (2006.01)
*H01R 12/72* (2011.01)

(52) U.S. Cl.
CPC ..... *H01R 12/724* (2013.01)

(58) Field of Classification Search
CPC .... H01R 31/06; H01R 23/025; H01R 31/065; H01R 27/02; H01R 2103/00
USPC ..... 439/638, 260, 218, 660
See application file for complete search history.

(56) References Cited

U.S. PATENT DOCUMENTS

| | | | | |
|---|---|---|---|---|
| 5,443,403 | A * | 8/1995 | Weidler et al. | 439/701 |
| 6,183,308 | B1 * | 2/2001 | Laity | 439/676 |
| 6,331,122 | B1 * | 12/2001 | Wu | 439/567 |
| 6,729,897 | B2 * | 5/2004 | Lai | 439/347 |
| 6,899,564 | B2 * | 5/2005 | Lee | 439/606 |
| 6,935,902 | B1 * | 8/2005 | Chou | 439/701 |
| 6,964,586 | B2 * | 11/2005 | Siddiqui | 439/669 |
| 7,198,503 | B1 * | 4/2007 | Chen et al. | 439/378 |
| 7,285,004 | B1 * | 10/2007 | Fukuda et al. | 439/358 |
| 7,371,091 | B2 * | 5/2008 | Kojori | 439/181 |
| 7,467,977 | B1 * | 12/2008 | Yi et al. | 439/607.01 |
| 7,623,182 | B2 * | 11/2009 | Byrne et al. | 348/375 |
| 7,815,450 | B1 * | 10/2010 | Chen et al. | 439/218 |
| 7,942,702 | B2 * | 5/2011 | Chang | 439/638 |
| 7,955,124 | B2 * | 6/2011 | Su et al. | 439/505 |
| 8,043,122 | B1 * | 10/2011 | Cho et al. | 439/638 |
| 8,162,691 | B2 * | 4/2012 | Chang | 439/541.5 |
| 8,353,724 | B2 * | 1/2013 | Shi et al. | 439/625 |
| 8,430,692 | B2 * | 4/2013 | Peng et al. | 439/607.46 |
| 8,579,519 | B2 * | 11/2013 | Wu | 385/75 |
| 8,632,351 | B2 * | 1/2014 | Wu | 439/248 |

(Continued)

FOREIGN PATENT DOCUMENTS

CN 201336489 Y * 10/2009

*Primary Examiner* — Abdullah Riyami
*Assistant Examiner* — Vladimir Imas
(74) *Attorney, Agent, or Firm* — Ference & Associates LLC

(57) ABSTRACT

An aspect provides a combination power and data connector, including: a dedicated power connector element; and a combination data connector element separate from the dedicated power connector element, the combination data connector element providing a combination of pins for two data transmission protocols. Other aspects are described and claimed.

20 Claims, 21 Drawing Sheets

(56) References Cited

U.S. PATENT DOCUMENTS

2010/0158449 A1* 6/2010 Yi ..... 385/75
2012/0077384 A1* 3/2012 Bar-Niv et al. ..... 439/625
2012/0115359 A1* 5/2012 Ko et al. ..... 439/578
2012/0149214 A1* 6/2012 Zhang et al. ..... 439/55
2012/0214326 A1* 8/2012 Ko et al. ..... 439/345
2013/0217274 A1* 8/2013 Bar-Niv et al. ..... 439/676
2014/0057495 A1* 2/2014 Liao et al. ..... 439/660
2014/0141639 A1* 5/2014 Saunders et al. ..... 439/350

* cited by examiner

Example PCB Layout Docking Connector

Example PCB Layout Sink Connector

COMBINATION POWER AND DATA CONNECTOR

BACKGROUND

Information handling devices ("devices"), for example laptop or desktop computers and the like, are used to handle information for a variety of user tasks. Users often couple information handling devices to one another, for example connecting a laptop computer to a dock. Commonly physical connections are employed, for example connecting devices via one or more cables/plugs. For example, a dock connected to another device, such as a laptop, provides the user with the ability to utilize connect devices, such as for example providing high quality video output from a laptop to a connected display via the dock.

BRIEF SUMMARY

In summary, one aspect provides a combination power and data connector, comprising: a dedicated power connector element; and a combination data connector element separate from said dedicated power connector element, said combination data connector element providing a combination of pins for two data transmission protocols.

Another aspect provides an information handling device, comprising: one or more processors; a printed circuit board; and a combination power and data connector connected to the printed circuit board, the combined power and data connector including: a dedicated power connector element; and a combination data connector element separate from said dedicated power connector element, said combination data connector element providing a combination of pins for two data transmission protocols.

A further aspect provides an insertion element, comprising: a dedicated power-insertion element; and a combination data-insertion element separate from said dedicated power-insertion element, said combination data-insertion element providing a combination of pins for two data transmission protocols.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
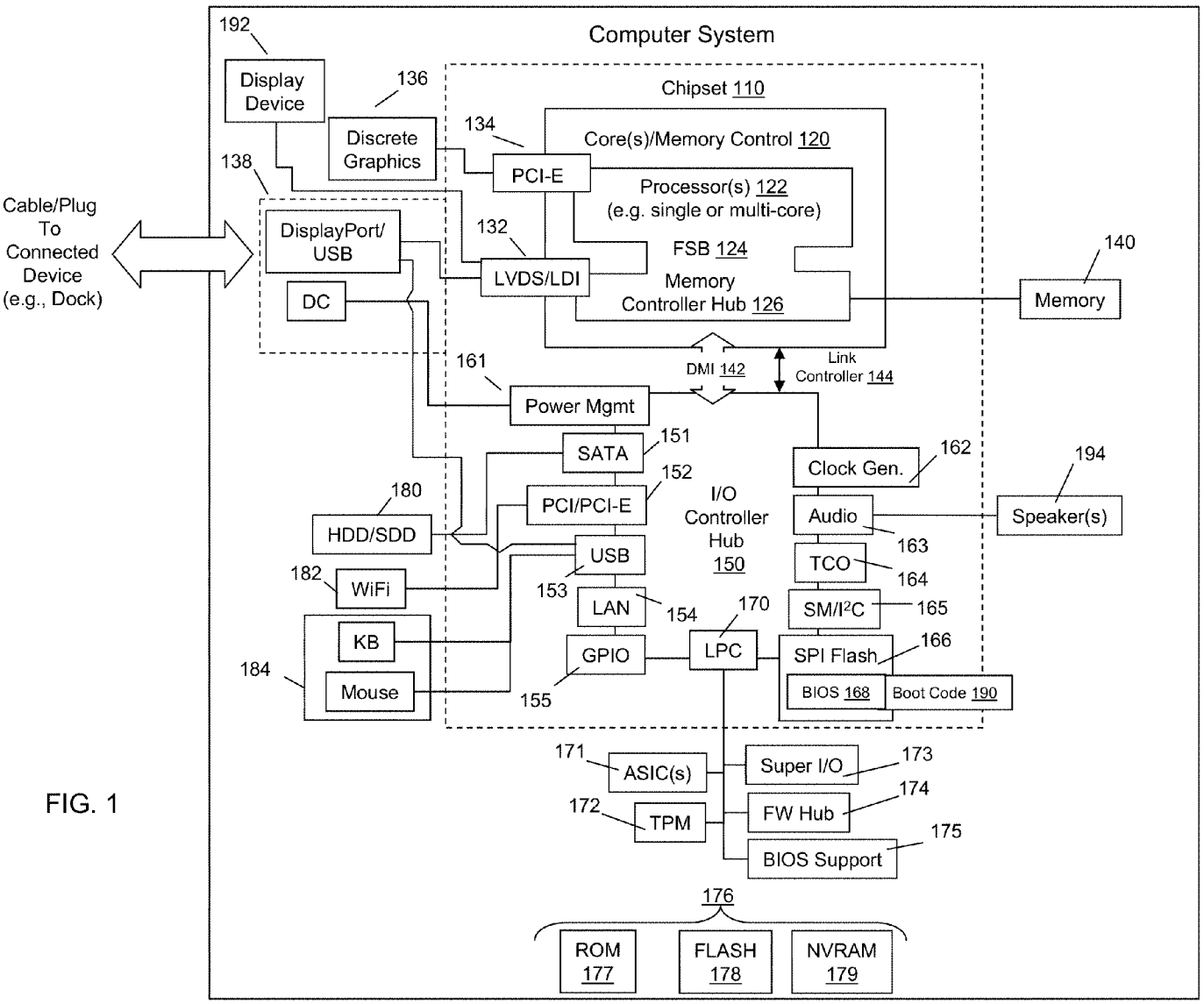
FIG. 1 illustrates an example information handling device and components thereof

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

In coupling information handling devices, e.g., a dock and a laptop computer ("devices"), a physical connection is often made there-between using one or more cables/plugs. The physical connection via cable/plug typically facilitates data transmission. For example, in a conventional dock, a DisplayPort ("DP") connection provides an interface primarily used to connect a video source (e.g., laptop computer) to a display device (monitor, HDTV, etc.) via an intervening dock device. Thus, the laptop and the dock are connected using a DP connection.

Docks are beneficial because they provide one connection from the source (e.g., laptop computing device) to the dock (sink device), as all of the I/O is/are connected to the dock. Without a dock, a user has to connect many cables (e.g., video, keyboard, mouse, DC-in, Ethernet, etc.). Conventionally, docks have very large connectors in order to provide for all of the I/O connections (e.g., video, keyboard, mouse, DC-in, Ethernet, etc.). Usually these large connectors are on the bottom of laptop computing device. A problem with this approach is that large connectors make the form factor (e.g., laptop) very thick, which may be undesirable.

Alternatively, a dock may be connected using a single connector, e.g., a universal serial bus (USB) cable dock. In such a dock, there is only a connector from the USB port of the laptop computer to the dock. A problem with this approach is that the performance of the dock is poor, as there is not enough bandwidth for USB, video, etc., and no provision for charging the source (e.g., laptop computer) is provided. Moreover, such docks require additional hardware on the dock to convert USB to video, etc., and this adds to the cost of the dock and has tended to cause driver problems (e.g., poor video quality). However, such USB docks have been implemented, with an advantage being this approach provides a single, low cost, small cable connection, versus a large, high cost, connection that makes the form factor thicker.

Accordingly, an embodiment provides a combination power and data connector that aligns a combination data connector element (e.g., DisplayPort (DP) and USB data connections) and a DC power connector element. Thus, an embodiment provides the best of both, i.e., full functionality (e.g., adequate bandwidth for data transmission), with an ability to charge the source (e.g., laptop computer), without requiring additional hardware on dock and with a single cable connection that does not appreciably increase thickness of the form factor (e.g., laptop computer).

Using such an arrangement, an embodiment permits connection of devices (e.g., connection of a laptop computer and a dock), wherein data transmission and DC power are provided using a single combination connector. The combination power and data connector may be matched with a combination cable/plug or insertion element (e.g., combined DP, USB and DC power plug and cable), as further described herein.

The illustrated example embodiments will be best understood by reference to the figures. The following description is intended only by way of example, and simply illustrates certain example embodiments. Certain figures include dimensions. In the figures all dimensions given are in millimeters (mm) unless otherwise stated.

FIG. 1 depicts a block diagram of one example of information handling device circuits, circuitry or components. The example depicted in FIG. 1 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 1.

The example of FIG. 1 includes a so-called chipset 110 (a group of integrated circuits, or chips, that work together, chipsets) with an architecture that may vary depending on manufacturer (for example, INTEL, AMD, ARM, etc.). The architecture of the chipset 110 includes a core and memory control group 120 and an I/O controller hub 150 that exchanges information (for example, data, signals, commands, et cetera) via a direct management interface (DMI) 142 or a link controller 144. In FIG. 1, the DMI 142 is a chip-to-chip interface (sometimes referred to as being a link between a "northbridge" and a "southbridge"). The core and memory control group 120 include one or more processors 122 (for example, single or multi-core) and a memory controller hub 126 that exchange information via a front side bus (FSB) 124; noting that components of the group 120 may be integrated in a chip that supplants the conventional "northbridge" style architecture.

In FIG. 1, the memory controller hub 126 interfaces with memory 140 (for example, to provide support for a type of RAM that may be referred to as "system memory" or "memory"). The memory controller hub 126 further includes embedded DisplayPort (eDP) 132, or some similar interface, e.g., a LVDS interface, for handling inputs and outputs, e.g., to a display device 192 (for example, a CRT, a flat panel, touch screen, et cetera) and/or to a connected device (e.g., a dock). A block 138 includes combination power and data connector, for example providing input connector elements for combined DP/USB, and DC power, as further described herein. Some other technologies that may be supported via the interface 132 include for example serial digital video and HDMI/DVI. The memory controller hub 126 also includes a PCI-express interface (PCI-E) 134 that may support discrete graphics 136.

In FIG. 1, the I/O hub controller 150 includes a SATA interface 151 (for example, for HDDs, SDDs, 180 et cetera), a PCI-E interface 152 (for example, for wireless connections 182), a USB interface 153 (for example, for devices 184 such as a digitizer, keyboard, mice, cameras, phones, microphones, storage, other connected devices, such as a dock or other peripheral device connected via a combination power and data connector 138, et cetera), a network interface 154 (for example, LAN), a GPIO interface 155, a LPC interface 170 (for ASICs 171, a TPM 172, a super I/O 173, a firmware hub 174, BIOS support 175 as well as various types of memory 176 such as ROM 177, Flash 178, and NVRAM 179), a power management interface 161 (e.g., for managing power via DC input element of combined power and data connector 138), a clock generator interface 162, an audio interface 163 (for example, for speakers 194), a TCO interface 164, a system management bus interface 165, and SPI Flash 166, which can include BIOS 168 and boot code 190. The I/O hub controller 150 may include gigabit Ethernet support.

The system, upon power on, may be configured to execute boot code 190 for the BIOS 168, as stored within the SPI Flash 166, and thereafter processes data under the control of one or more operating systems and application software (for example, stored in system memory 140). An operating system may be stored in any of a variety of locations and accessed, for example, according to instructions of the BIOS 168. As described herein, a device may include fewer or more features than shown in the system of FIG. 1.

Information handling devices, as for example outlined in FIG. 1, may include user devices such as a laptop computer to be connected to one or more other devices, for example a dock. An embodiment provides a combination power and data connector (docking connector 138 or sink connector 189) that facilitates data transmission and power provisioning in a convenient connection arrangement (with a combination insertion component, such as a combination cable/plug), such that a plurality of connections (e.g., data and power) may be made using a single connection (i.e., a user may connect a single combination cable/plug to effect data and power connections).

Figure 2:
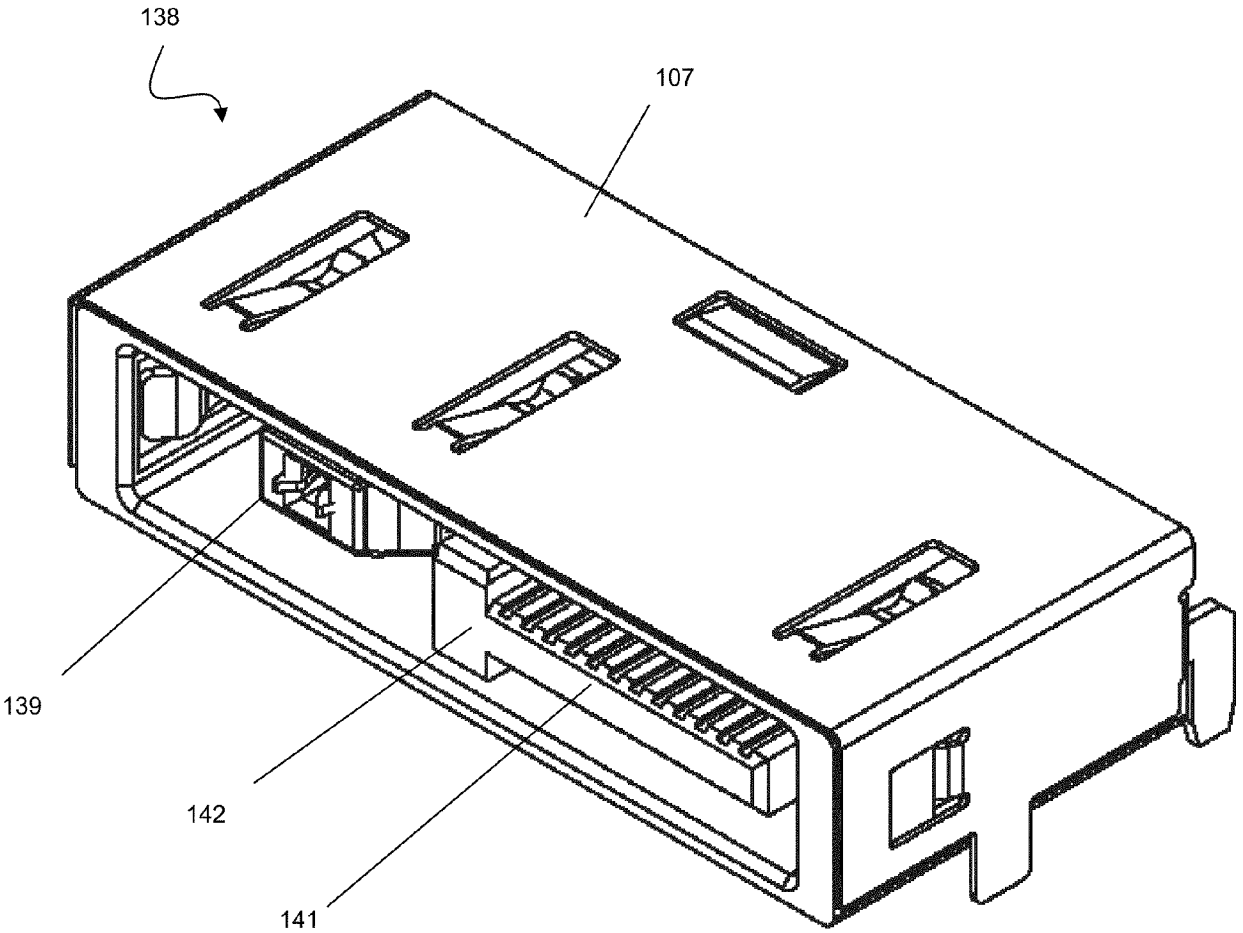
FIG. 2 illustrates a perspective view of an example combination power and data connector (docking connector).

Referring to FIG. 2, a perspective view of an example combination power and data connector (docking connector) 138 is illustrated. The docking connector 138 includes both a power connector element 139 and a combination data connector element 141 enclosed in a shell 107, which may comprise a copper alloy shell material.

Figure 20:
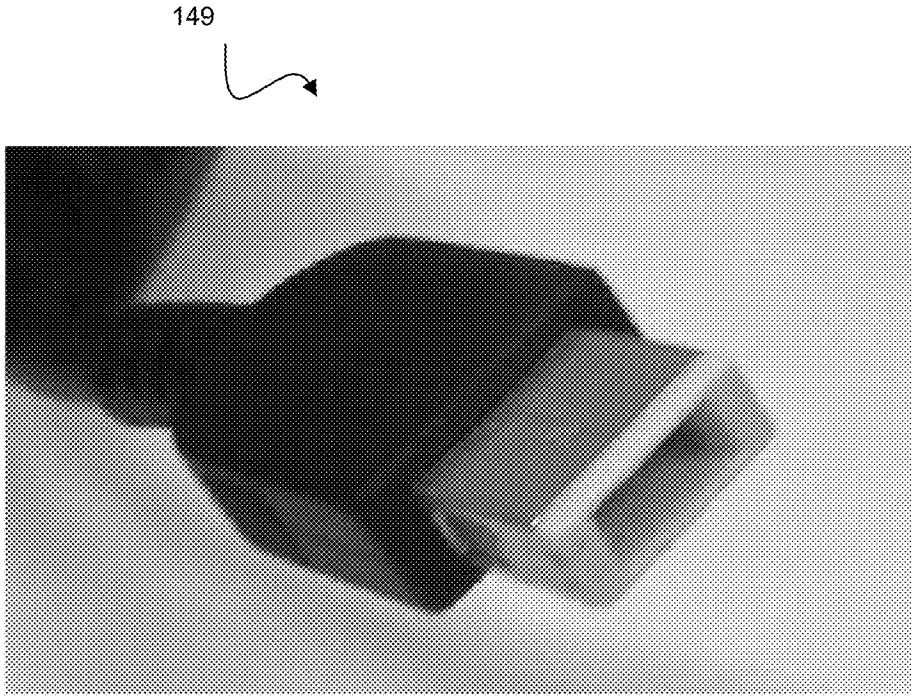
FIG. 20 illustrates an example power cable alone.

The power connector element 139 provides for connection of a power cable/plug, for example a DC power supply cable/plug 149 (illustrated in FIG. 20). The DC power supply cable/plug 149 that connects to the power connector element 139 may for example include a DC power supply cable/plug. A power supply cable/plug that connects to the power connector element 139 may also comprise a portion of a combination (power and data) cable/plug (insertion element 146), as further described herein.

The data connector element 141 may provide both USB and DisplayPort connectivity. The combined USB and DisplayPort connectivity is provided by a plurality of pins 143 (refer to FIG. 3) included in the data connector element 141. The pins 143 of the combination data connector element 141 mate with an appropriate data cable/plug contacts/pins and of a corresponding data connector element 148 provided in a data cable/plug, thus providing connectivity to an underlying printed circuit board (PCB) (as for example illustrated in FIG. 12).

Figure 3:
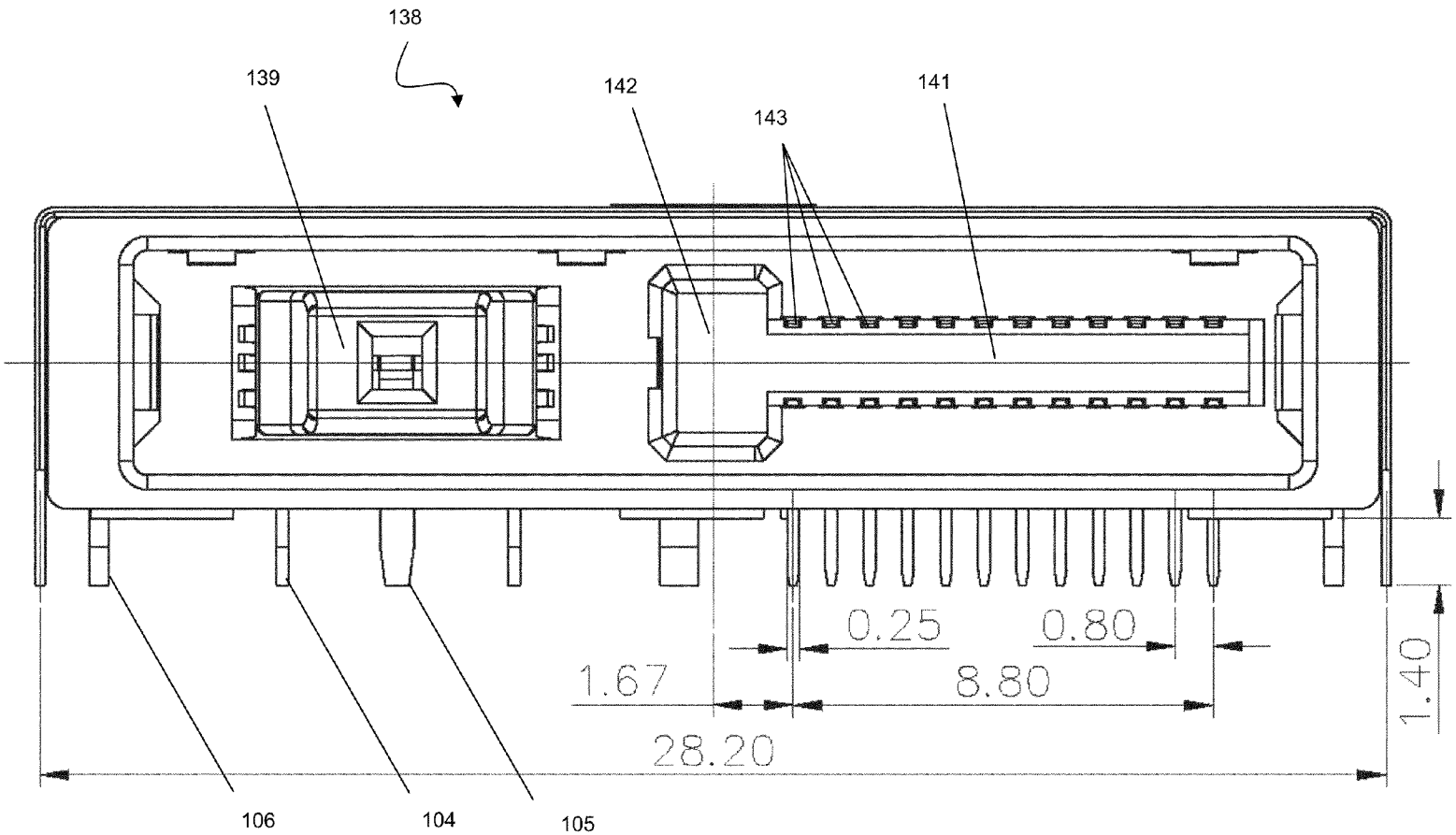
FIG. 3 illustrates a front view of the example docking connector.

The docking connector 138 is illustrated in a front plan view in FIG. 3. The power connector element 139 is disposed adjacent to the combination data connector element 141. The combination data connector element 141 may include a post element 142 which provides a user with assistance in alignment of the data cable/plug (insertion element 146) for insertion into the docking connector 138. The post element 142 may comprise a plastic material.

Also illustrated in FIG. 3 are a plurality of contact elements for contacting with an underlying PCB (refer to FIG. 12), including a power contact element 104, a detect contact element 105, and a ground contact element 106. Each contact element illustrated corresponds to a PCB position, each of which is further described in connection with Table 1 and FIG. 12. Each of the contact elements, including the power contact element 104, the detect contact element 105, and the ground contact element 106, may comprise a copper alloy.

Figure 4:
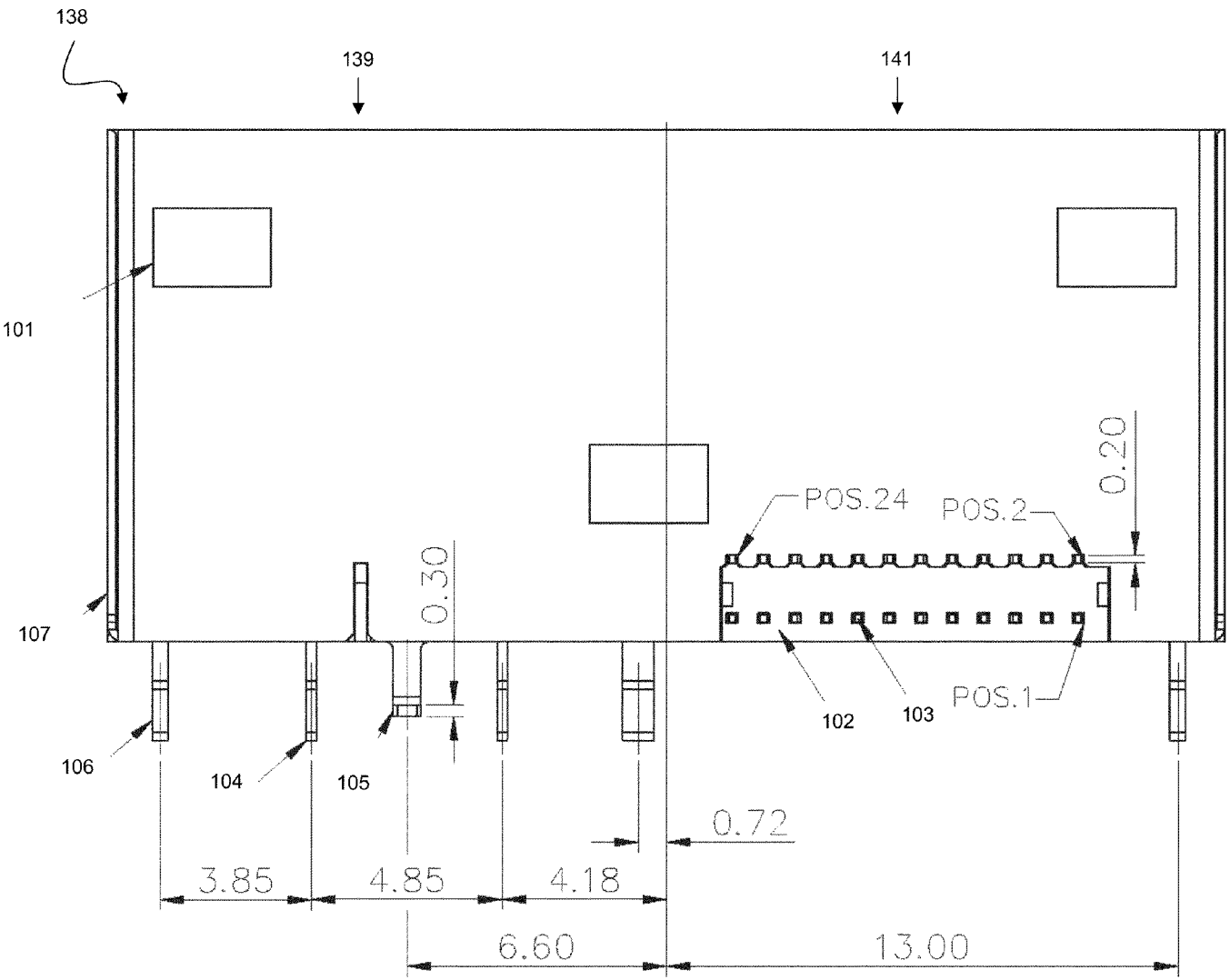
FIG. 4 illustrates a bottom view of the example docking connector.

A bottom view of the docking connector 138 is provided by FIG. 4. Illustrated are a plurality of contact elements including the power contact element 104, the detect contact element 105, and the ground contact element 106, as well as a signal contact element 103. The internal portions of the docking connector 138 may include a cover formed of high-temperature resistant plastic material. Example pin positions (of combination data connector element 141) are illustrated. In the illustration three pin positions (POS. 1, POS. 2 and POS. 24) illustrated are called out specifically by way of example and correspond to pin positions described in connection with Table 1 and illustrated in FIG. 12.

Figure 5:
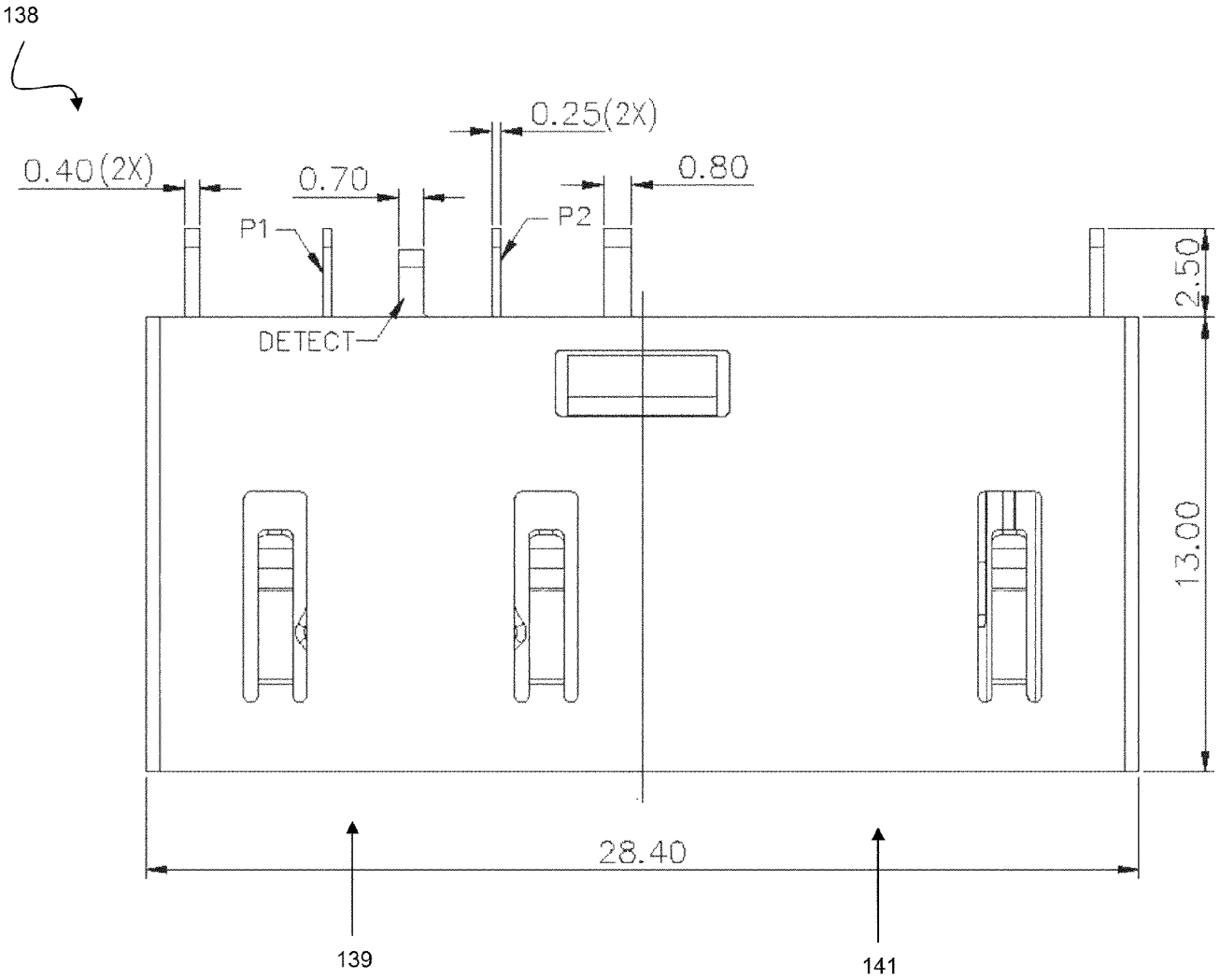
FIG. 5 illustrates a top view of the example docking connector.

As described herein, the docking connector 138 may include a copper alloy shell element 107 as well as a housing 101, which, similar to cover 102, may be formed for example of high-temperature resistant plastic. FIG. 5 illustrates a corresponding top view of the docking connector 138, with power connector element 139 and combination data connector element 141 positions indicated. In FIG. 5, P1 and P2 correspond to power contact elements for contacting with a PCB (as with other contact elements described herein, refer to FIG. 12).

Figure 6:
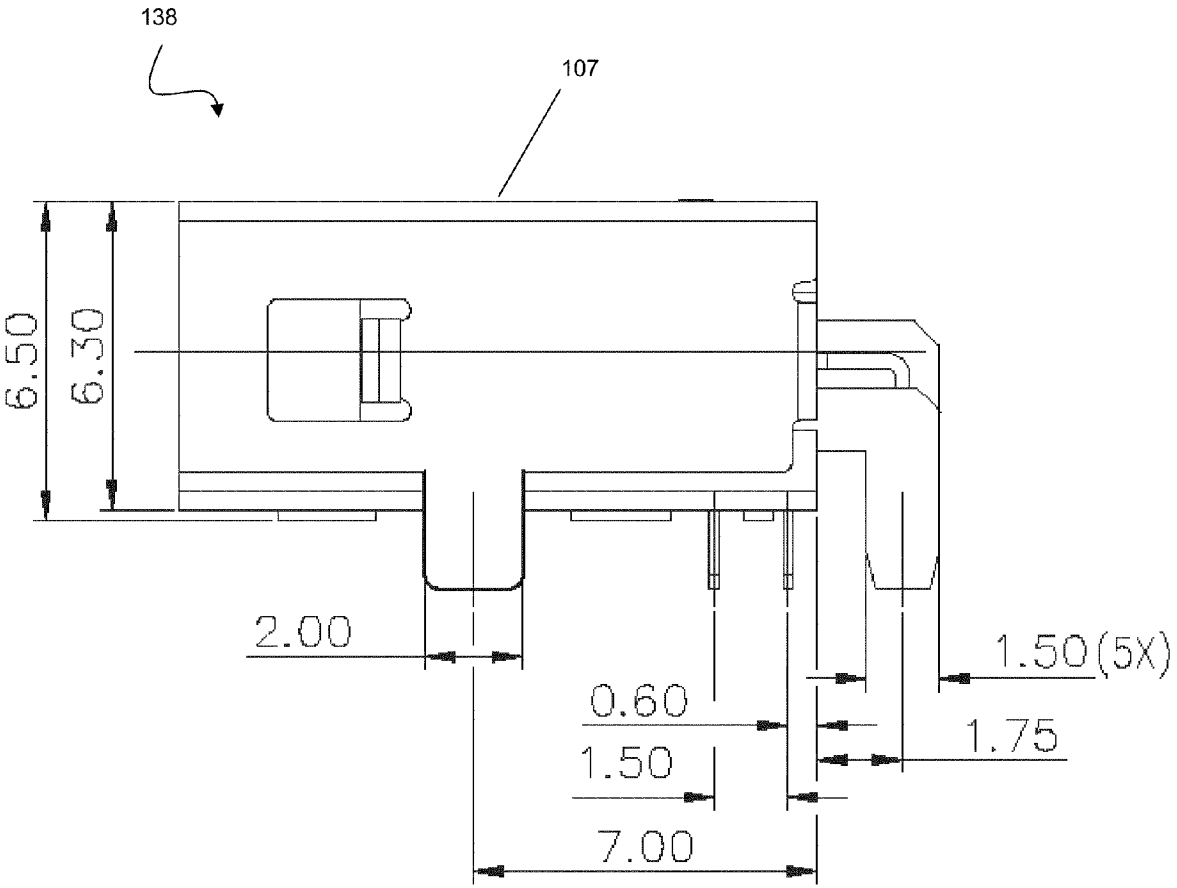
FIG. 6 illustrates a side view of the example docking connector.

FIG. 6 illustrates a side view of the docking connector 138, which is covered substantially by shell element 107. Contact elements for contacting a PCB are illustrated protruding from the bottom of the docking connector 138 and correspond to a side view of those illustrated in FIG. 4 (bottom view). The side view illustrated in FIG. 6 corresponds to a view in which the power connector element 139 and the combination data connector element 141 are facing left, i.e., corresponding to an outer surface of a device such as a laptop computer, such that an insertion element 146 (e.g., of a combination cable) may be inserted from the left to mate with the docking connector 138.

Figure 7:
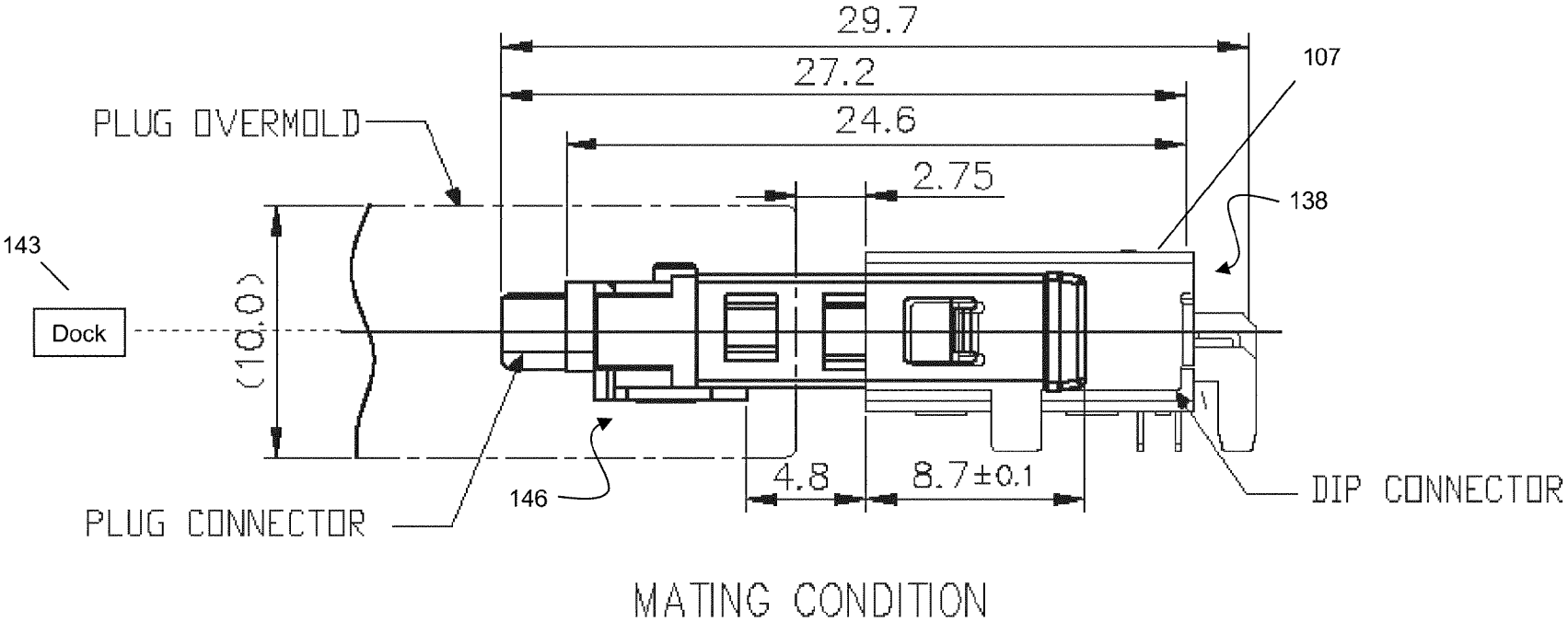
FIG. 7 illustrates a side view of the example docking connector in a mating condition with a plug connector.
Figure 8A:
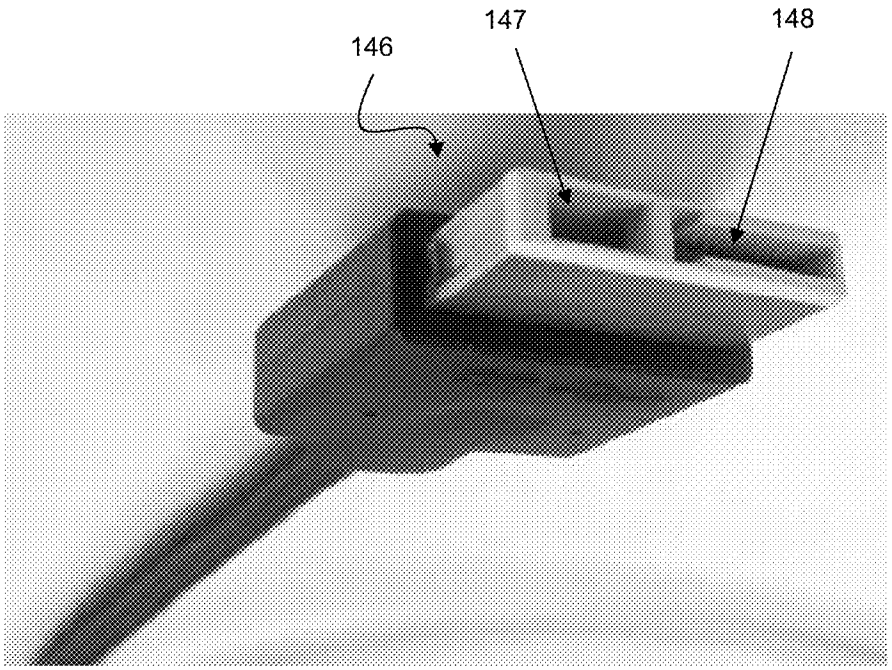
FIG. 8A illustrates a perspective view of an example plug connector for insertion into the docking connector.

In a mating condition, as illustrated in FIG. 7, docking connector 138 connects with a plug connector, e.g., insertion element 146, as illustrated. A plug connector may be inserted into one or more of the power connector element 139 and the combination data connector element 141. A plug connector or insertion element may thus be a power cable/plug 149 (FIG. 20), which may be a proprietary power cable/plug, and which connects separately from a combination data cable/plug (not illustrated). Alternatively, a combination power and data insertion element 146 (illustrated in FIG. 8A as a "combination cable") may be provided, for example a combination power and data cable/plug that inserts in one step into the docking connector 138. The insertion element 146 may include both a power plug element 147 and a combination data plug element 148 (e.g., providing both DP and USB (e.g., USB 3) functionality), suitably arranged to mate appropriately with the docking connector 138, as further described in connection with FIG. 8(A-B).

In the view provided by FIG. 7, the plug connector comprises the end of an insertion element 146 that is inserted into the docking connector 138 as the docking connector 138 is situated into a device, for example a laptop computing device, such that the front of the docking connector 138 (as illustrated in FIG. 3) is exposed to the exterior of the device, herein a leftward orientation. Accordingly, a user may insert insertion element 146 into the docking connector 138 from the left, effecting a power and data connection. In the case of a combination power and data cable/plug, a user may accomplish both power and data connectivity with a single insertion. The plug connector may connect a variety of devices for which data connectivity is desired, for example connecting a laptop computer to a dock device 143.

Figure 18:
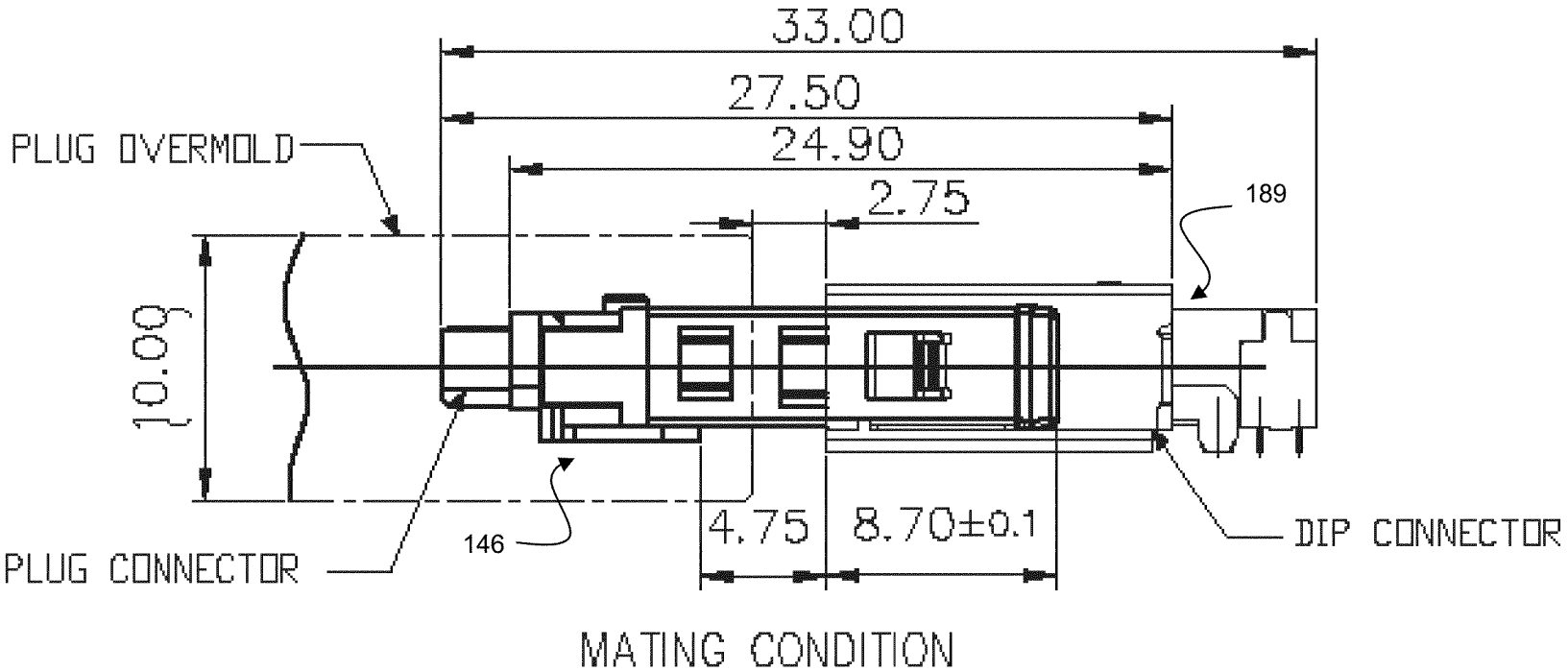
FIG. 18 illustrates a side view of the example sink connector in a mating condition with the plug connector.

Illustrated in FIG. 8(A-B) is an example insertion element 146 that may be inserted into the docking connector 138 (as well as into a sink connector 189, refer to FIG. 18). The insertion element 146 comprises mirrored components for insertion into the respective connector, e.g., docking connector 138. Thus, the insertion element 146 includes a power-insertion element 147 (e.g., DC-in) that corresponds and mates with the power connector element 139. Thus, when power-insertion element 147 is inserted onto the power connector element 139, a charging arrangement is provided for the source (e.g., a laptop computer containing the docking connector 138 or the sink connector 189).

Moreover, the insertion element 146 includes a combination data-insertion element 148 that corresponds and mates with the combination data element 141 of the docking connector 138. Thus, when the combination data-insertion element 148 is inserted onto the combination data element 141 a data transmission arrangement is provided for data transmission between the source (e.g., a laptop computer containing the docking connector 138) and a peripheral device connected to the other end of the cable 146 (e.g., a device having a sink connector 189, as further described herein).

In an embodiment, the data transmission arrangement provided allows for transmission of two or more data transmission formats or protocols by virtue of inclusion of pins for each, e.g., USB and DisplayPort, in the single combination data-insertion element 148. As described herein, the peripheral device connected to the insertion element 146 may be a dock or other peripheral device. The peripheral device may also include a connector, e.g., in the case of a combination cable having insertion elements 146 at both ends (i.e., a combination of power-insertion element 147 and combination data-insertion element 148 in a single combination cable). Alternatively, an insertion element 146 may have one end terminate in combination elements and the other end of the combination cable may be hard wired to the peripheral device.

It should be noted that although an example insertion element 146 is provided, the inserted portion (i.e., that which is inserted onto the respective connector, e.g., docking connector 138) may be any element (insertion element) that may be inserted onto the respective connector, e.g., docking connector 138. Thus, an adaptor, a cable, a peripheral device including a combination cable or a direct connection using an insertion element 146 may be utilized so long as a connection with the respective connector, e.g., docking connector 138, is accomplished.

In this regard, rather than insertion element 146, one or more stand-alone cables may be inserted into the docking connector 138. Illustrated in FIG. 20 is an example of such a stand-alone cable in the form of a power cable 149. The power cable 149 may be inserted onto the power connector element 139 to provide DC-in power, i.e., for charging a device. Thus, the separate power and data cables may be plugged into the docking connector 138. The power cable 149 mirrors the power connector element 139 and has dimensions appropriate for insertion and connection thereto. Similarly, a stand alone combination data cable (not illustrated) may be inserted onto combination data connector element 141 to achieve a data-only connection.

Figure 8B:
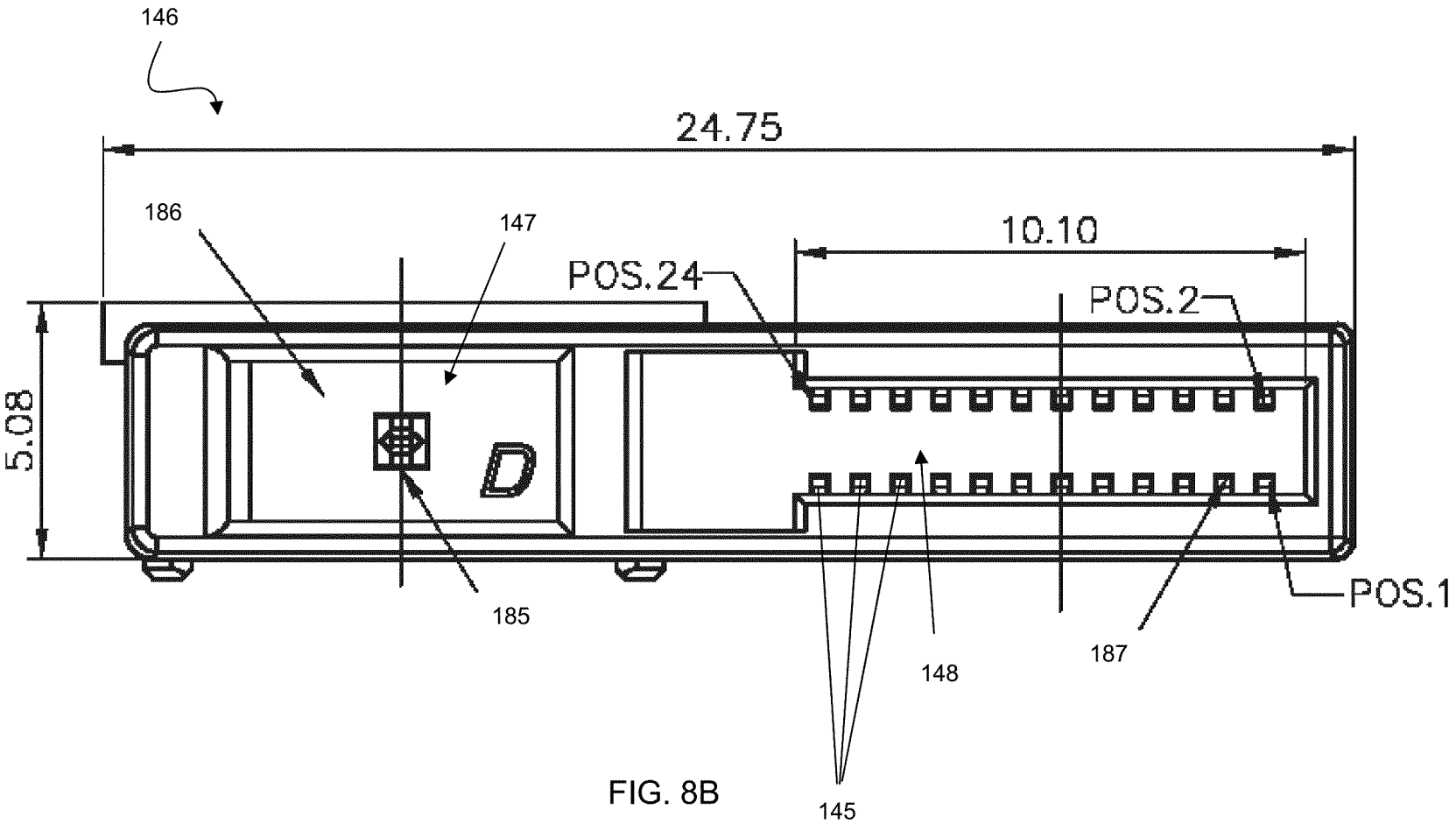
FIG. 8B illustrates a front view of the example plug connector.
Figure 9:
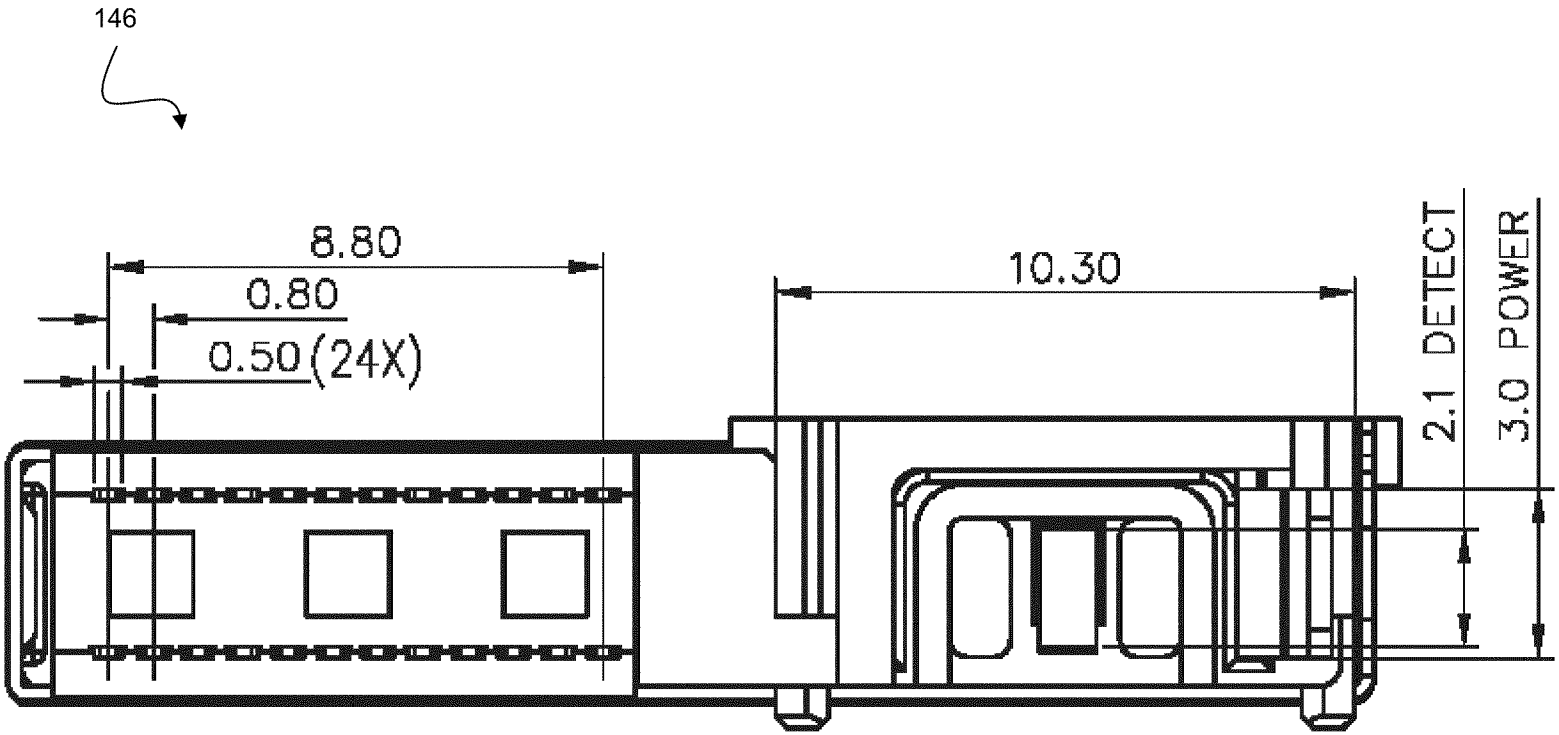
FIG. 9 illustrates a back view of the example plug connector.
Figure 10:
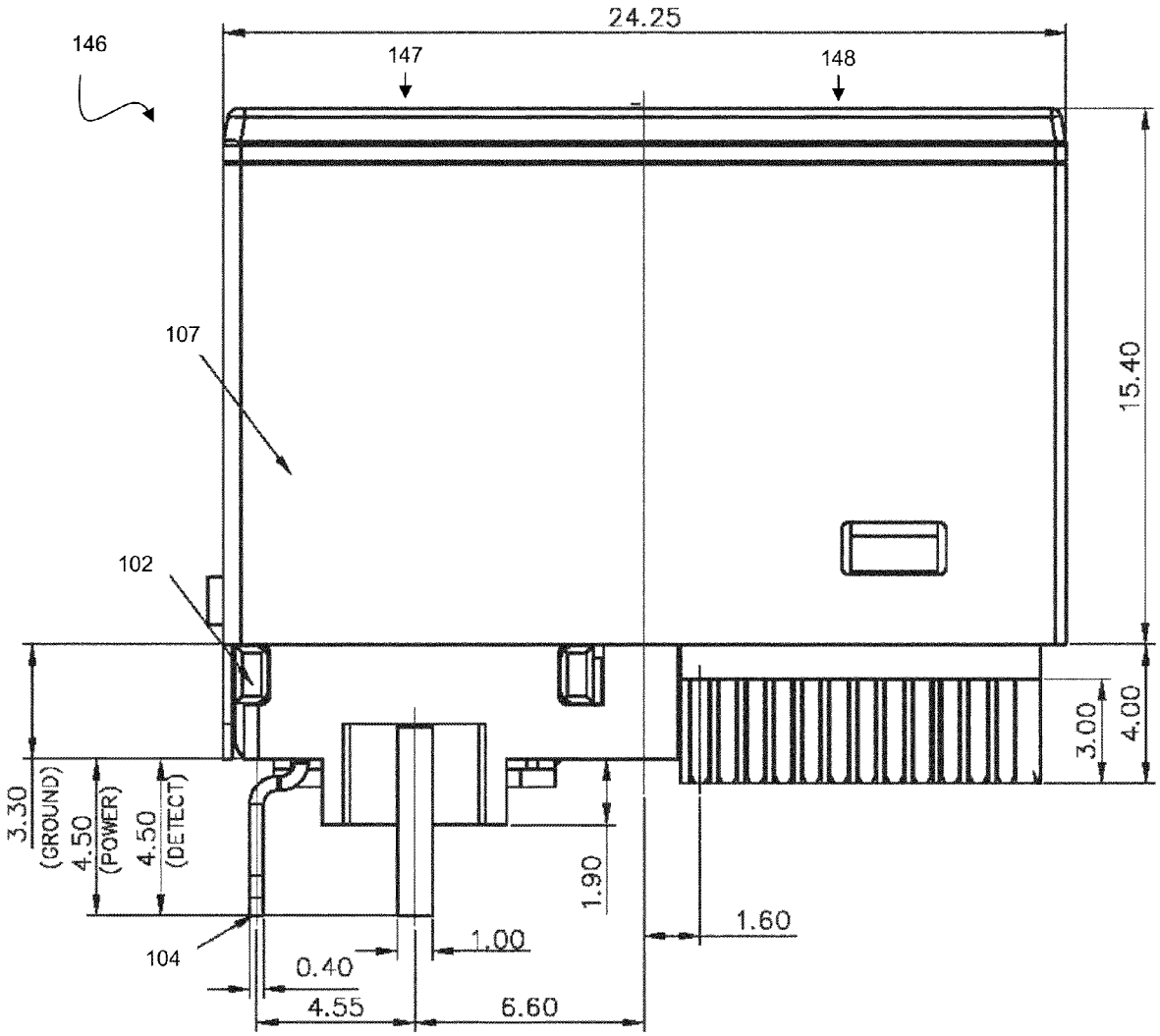
FIG. 10 illustrates a bottom view of the example plug connector.
Figure 11:
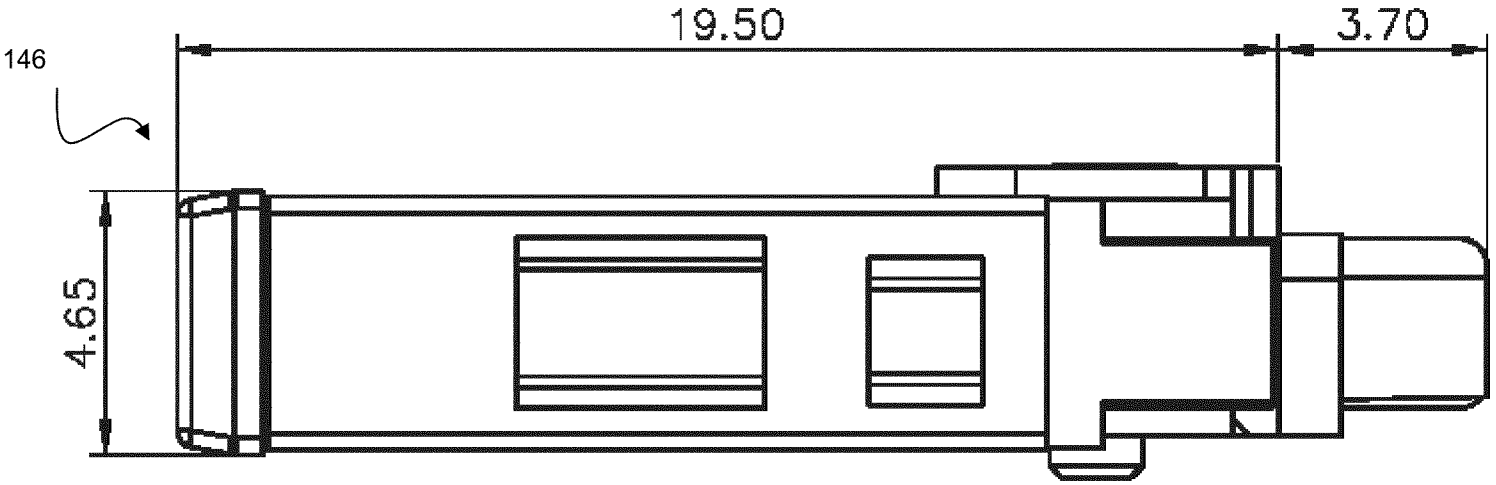
FIG. 11 illustrates a side view of the example plug connector.

FIG. 8B provides a front view of insertion element 146 (which again may be included as an insertion element fixed to a device, as a cable, etc.). The insertion element 146 includes corresponding or complimentary features to the docking connector 138 and sink connector 189 such that power and data connections may be accomplished there-between. Thus, insertion element 146 includes pins 145 (illustrated in FIG. 8B) which correspond to and mate with pins 143 of the connectors 138 (illustrated in FIG. 3) and 189 (illustrated in FIG. 14). FIG. 9 illustrates a back view of the insertion element 146 and FIG. 10 illustrates a bottom view thereof. FIG. 11 illustrates insertion element 146 in a side view, which corresponds to the views of the insertion element 146 in a mating condition with docking connector 138 and sink connector 189 (as illustrated in FIGS. 7 and 18, respectively).

Figure 12:
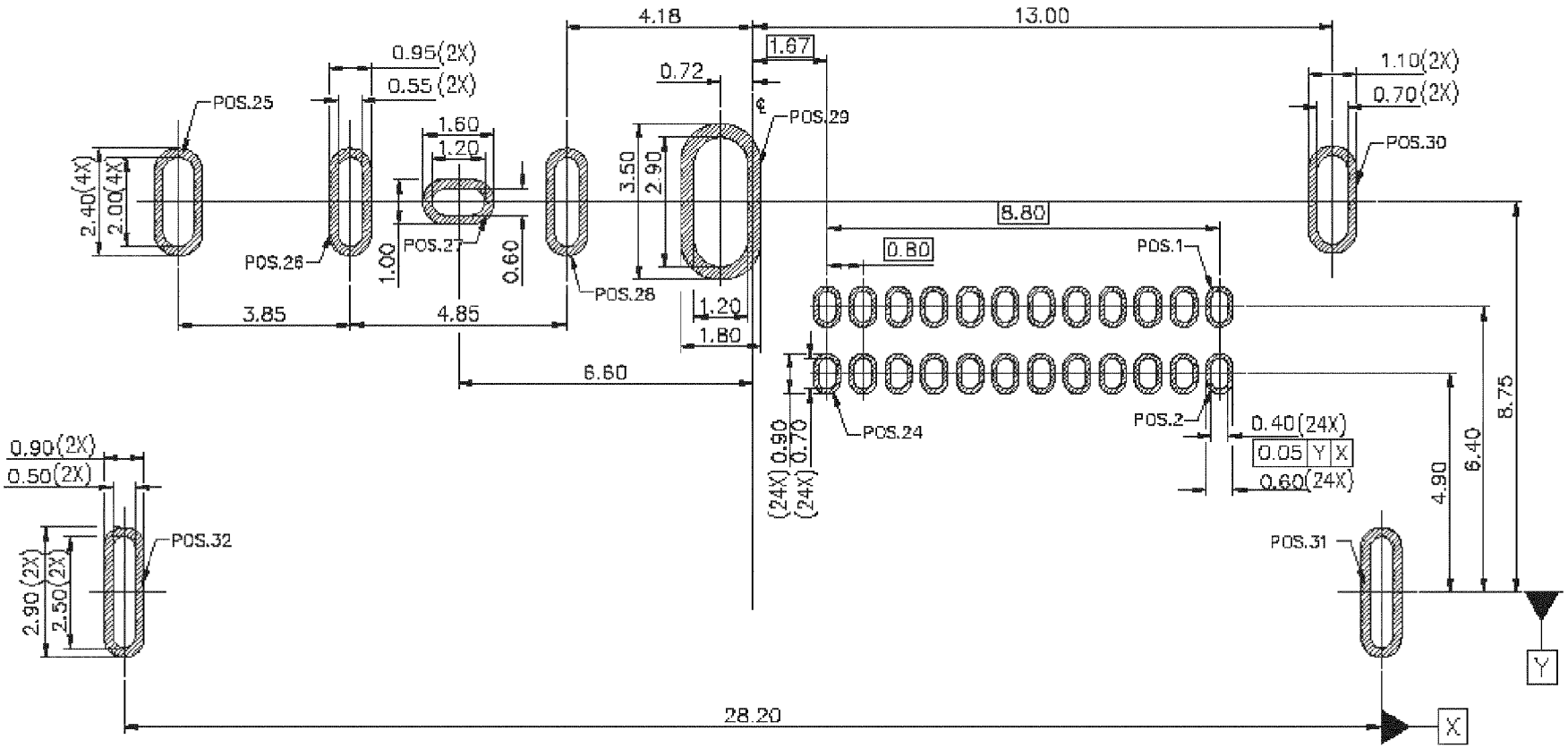
FIG. 12 illustrates an example printed circuit board (PCB) layout for the example docking connector.

The docking connector 138 provides connections to a PCB situated within a device, for example a laptop computer. An example layout of a PCB for a docking connector 138 is illustrated in FIG. 12. Here, position numbers (refer to Table 1) on the illustrated example PCB of FIG. 12 correspond to contact points of the docking connector 138. The power and data contact positions of Table 1 and illustrated in FIG. 12 include all contacts needed for provisioning power supply and data transmission via docking connector 138 to and from an information handling device, for example a device as outlined in FIG. 1.

TABLE 1

Docking Connector Positions and Definitions

| Position No. | Definition | Position No. | Definition |
|---|---|---|---|
| 1 | Ground | 2 | Power Button |
| 3 | ML_Lane0(p) | 4 | Return/Detect |
| 5 | ML_Lane0(n) | 6 | VBUS(500 mA) |

TABLE 1-continued

Docking Connector Positions and Definitions

| Position No. | Definition | Position No. | Definition |
|---|---|---|---|
| 7 | Ground | 8 | USB2.0(p) |
| 9 | ML_Lane1(p) | 10 | USB2.0(n) |
| 11 | ML_Lane1(n) | 12 | Ground |
| 13 | Ground | 14 | USB3.0_Rx(p) |
| 15 | AUX_CH(p) | 16 | USB3.0_Rx(n) |
| 17 | AUX_CH(n) | 18 | Ground |
| 19 | CONFIG1 (no connect) | 20 | USB3.0_Tx(p) |
| 21 | DOCK_CONSUMP | 22 | USB3.0_Tx(n) |
| 23 | HOT PLUG DETECT | 24 | Ground |
| 25 | Ground | 26 | POWER1 |
| 27 | DETECT | 28 | POWER2 |
| 29 | GROUND | 30 | GROUND |
| 31 | GROUND | 32 | GROUND |

Accordingly, an embodiment provides a device having a docking connector 138 which mates with corresponding power and data cable(s)/plug(s) ("insertion element"). The docking connector 138 provides an interface for establishing power and data contacts between cable/plug and a PCB of a device. Thus, the docking connector 138 facilitates a plurality of connections such that a user does not need to (but may) connect a plurality of corresponding cables/plugs to effect power and data transfer between devices.

Figure 13:
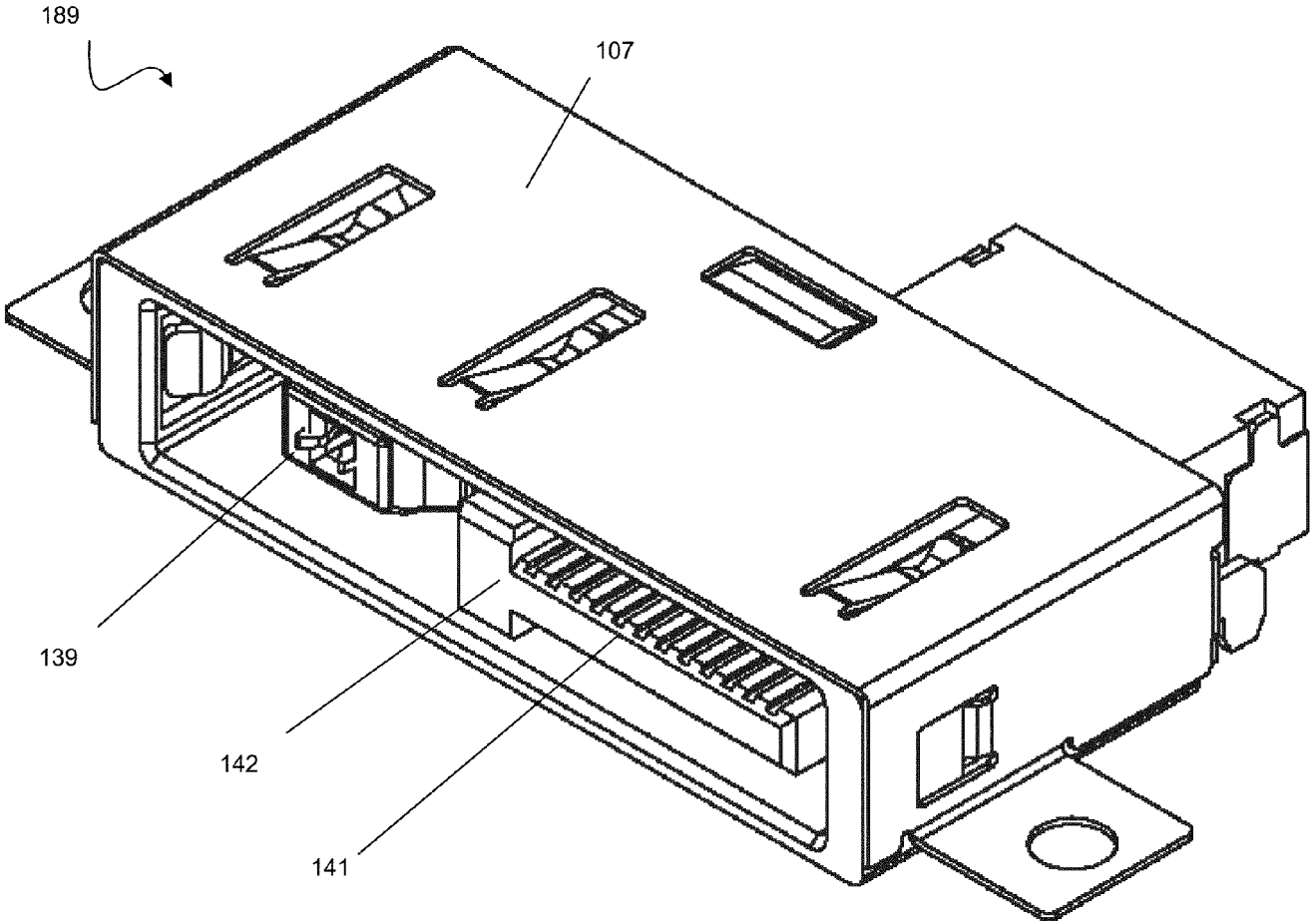
FIG. 13 illustrates another example combination power and data connector (sink connector).

As described herein, an insertion element 146 may likewise be connected into a sink connector 189. The sink connector 189 includes, similar to the docking connector 138, power and data connections. In this regard, a sink connector 189 is illustrated in FIG. 13.

Figure 14:
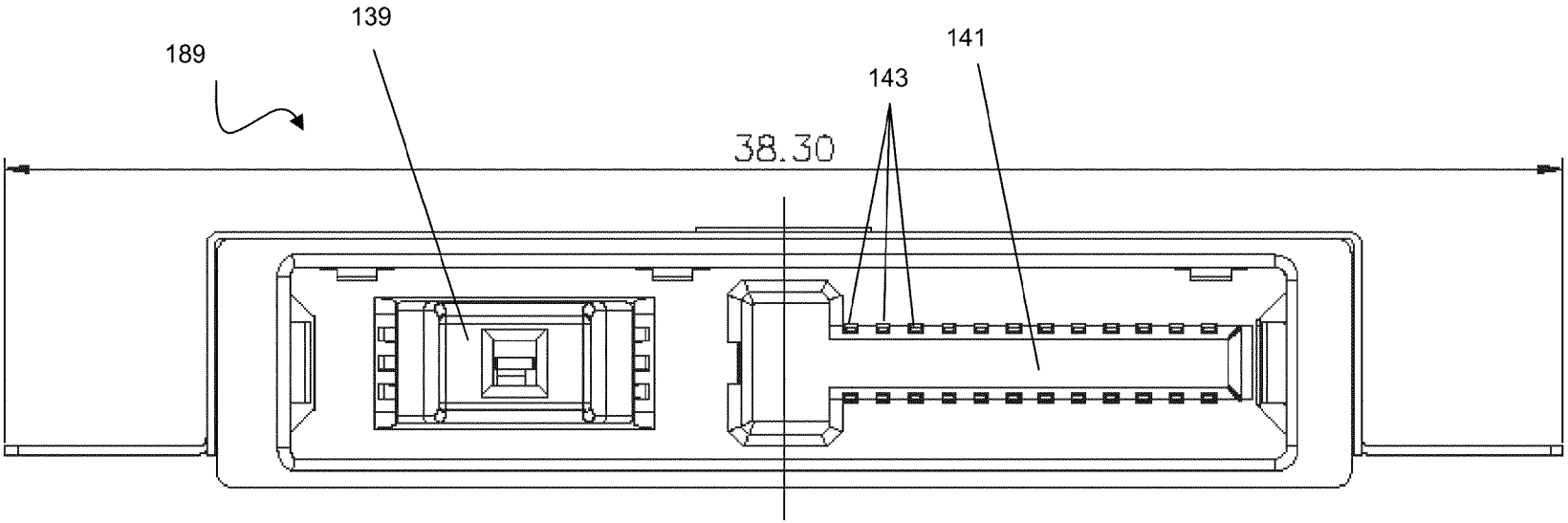
FIG. 14 illustrates a front view of the example sink connector.
Figure 15:
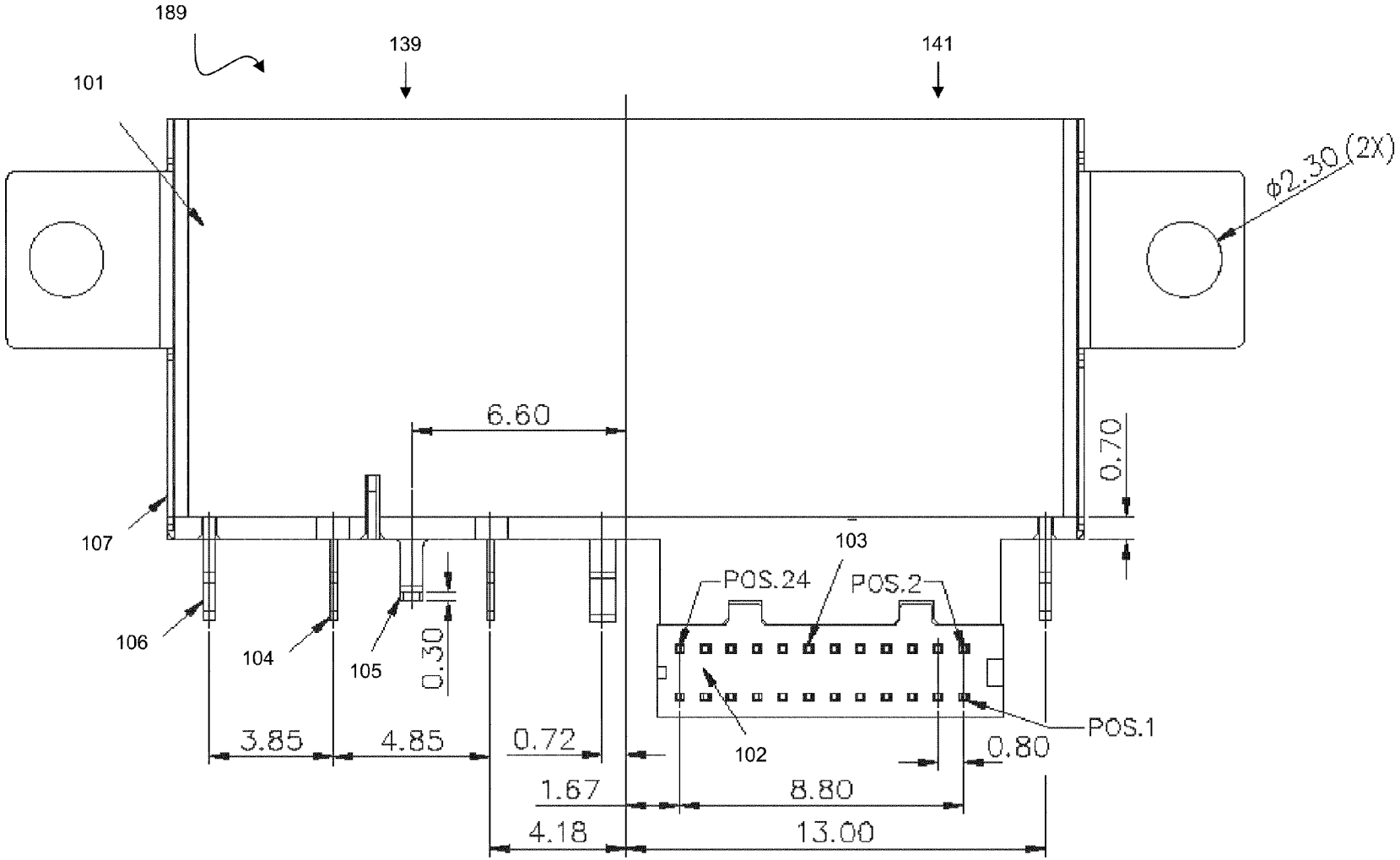
FIG. 15 illustrates a bottom view of the example sink connector.
Figure 16:
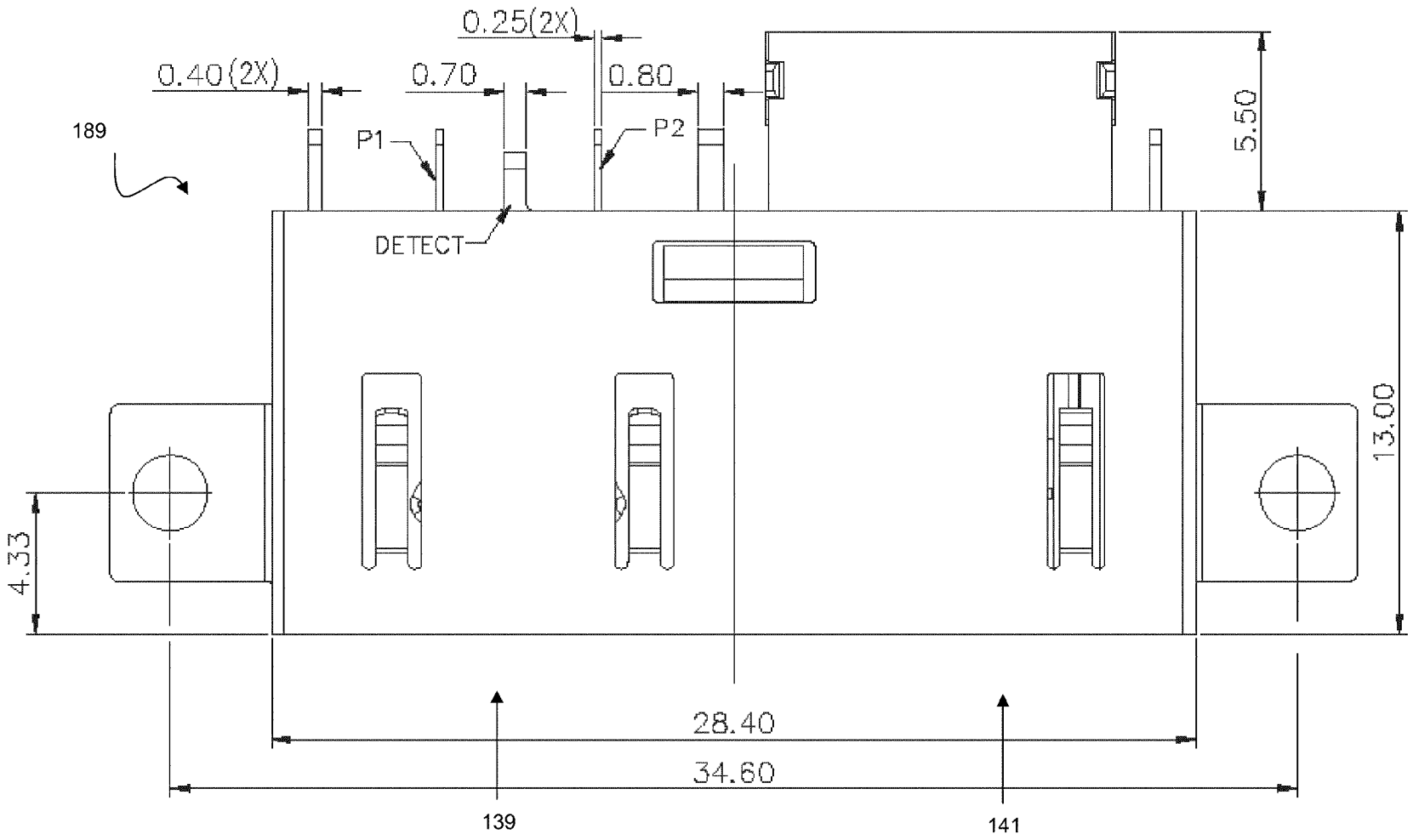
FIG. 16 illustrates a top view of the example sink connector.

The sink connector 189 corresponds to the docking connector 138 (e.g., as provided in a laptop computing device) and the choice of which to use may be based on system implementation. Thus, sink connector 189 includes power and data elements 139, 141, pins 143 and post element 142 for complimenting and mating with an insertion element 146, as does docking connector 138. FIG. 14 provides a front view of the sink connector 189 and pins thereof 143, whereas bottom view (illustrated in FIG. 15) illustrates that sink connector shares commonalities with docking connector 138 to provide combined power and data connectivity via an insertion element 146 (e.g., a combination cable). FIG. 16 provides a top view of the sink connector 189 and illustrates the relative locations of power connector element 139 and combination power and data element 141 thereof.

Figure 17:
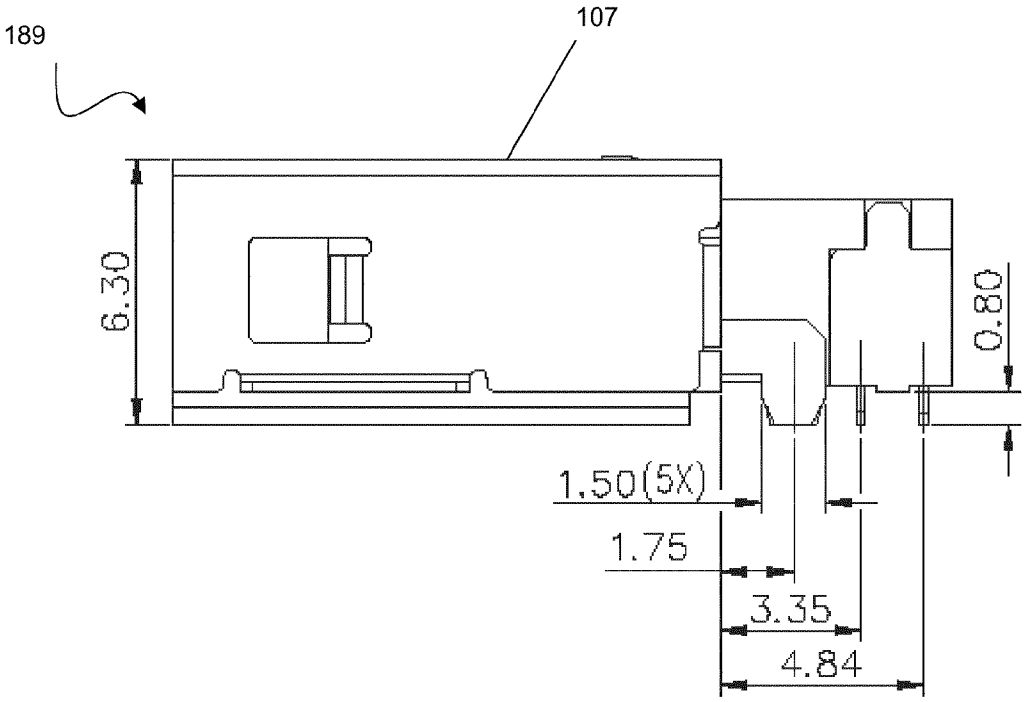
FIG. 17 illustrates a side view of the example sink connector.
Figure 19:
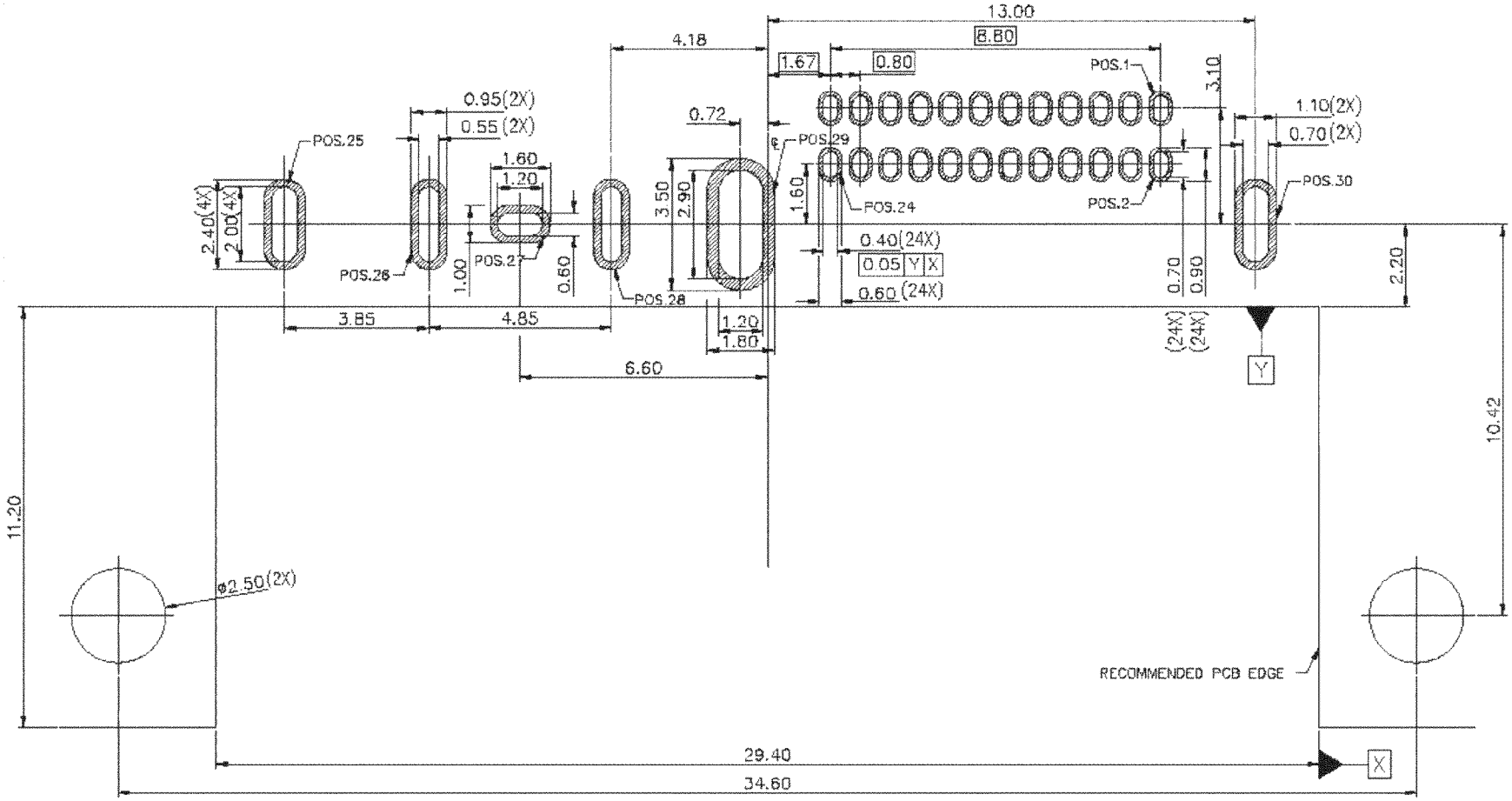
FIG. 19 an example printed circuit board (PCB) layout for the example sink connector.

As described herein, insertion element 146 may mate with sink element 189. A side view of the example sink element 189 is provided in FIG. 17, which corresponds to the side view of the sink element 189 in a mating condition with insertion element 146, as illustrated in FIG. 18. FIG. 19 (similar to FIG. 12 for docking connector 138) illustrates an example PCB layout for the sink connector, with pin positions corresponding to those in Table 2.

TABLE 2

Sink Connector Positions and Definitions.

| Position No. | Definition | Position No. | Definition |
|---|---|---|---|
| 1 | Ground | 2 | Power Button |
| 3 | ML_Lane0(p) | 4 | Return/Detect |
| 5 | ML_Lane0(n) | 6 | VBUS(500 mA) |

TABLE 2-continued

Sink Connector Positions and Definitions.

| Position No. | Definition | Position No. | Definition |
|---|---|---|---|
| 7 | Ground | 8 | USB2.0(p) |
| 9 | ML_Lane1(p) | 10 | USB2.0(n) |
| 11 | ML_Lane1(n) | 12 | Ground |
| 13 | Ground | 14 | USB3.0_Rx(p) |
| 15 | AUX_CH(p) | 16 | USB3.0_Rx(n) |
| 17 | AUX_CH(n) | 18 | Ground |
| 19 | CONFIG1 (no connect) | 20 | USB3.0_Tx(p) |
| 21 | DOCK_CONSUMP | 22 | USB3.0_Tx(n) |
| 23 | HOT PLUG DETECT | 24 | Ground |
| 25 | Ground | 26 | POWER1 |
| 27 | DETECT | 28 | POWER2 |
| 29 | GROUND | 30 | GROUND |

While the various example embodiments have been described in connection with various example devices that may be used in connection scenarios, these were provided as non-limiting examples. Accordingly, embodiments may be used to connect other devices in similar contexts. Although devices such as laptop computing and dock devices have been used in the description as specific examples, embodiments may be utilized in connection with other types of devices having suitable connection elements.

It will also be understood that the various embodiments may be implemented in one or more information handling devices having hardware connection elements and being appropriately configured to execute program instructions consistent with the functionality of the embodiments as described herein. In this regard, FIG. 1 illustrates a non-limiting example of such a device and components thereof.

As will be appreciated by one skilled in the art, various aspects may be embodied as a system, method or device. Accordingly, aspects may take the form of an entirely hardware embodiment or an embodiment including software that may all generally be referred to herein as a "device" or "system." Furthermore, aspects may include a device program product embodied in one or more device readable medium(s) having device readable program code embodied therewith. Any combination of one or more non-signal device readable medium(s) may be utilized in this regard to store executable program instructions.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A combination power and data connector, comprising:

a dedicated power connector element; and a combination data connector element separate from said dedicated power connector element, said combination data connector element having a combination of pins disposed in the combination data connector element for two data transmission protocols;

the combination data connector element formed to accept a single insert element having a combination of pins for two data transmission protocols.

2. The combination power and data connector of claim 1, wherein the two data transmission protocols comprise Displayport and USB.

3. The combination power and data connector of claim 1, wherein the combination data connector element further comprises a post element disposed at one end of the combination data connector element.

4. The combination power and data connector of claim 3, wherein the dedicated power connector element is disposed adjacent to an end of the combination data connector element where the post element is situated.

5. The combination power and data connector of claim 1, wherein the combination of pins for two data transmission protocols comprise:

first side of pins for a first data transmission protocol; and second side of pins for a second data transmission protocol.

6. The combination power and data connector of claim 5, wherein the first side of pins comprise USB pins.

7. The combination power and data connector of claim 6, wherein the first side of pins further comprise one or more power pins.

8. The combination power and data connector of claim 7, wherein the one or more power pins is other than the dedicated power connector element.

9. The combination power and data connector of claim 5, wherein the second side of pins comprise DisplayPort pins.

10. An information handling device, comprising:

one or more processors;

a printed circuit board; and a combination power and data connector connected to the printed circuit board, the combined power and data connector including:

a dedicated power connector element; and a combination data connector element separate from said dedicated power connector element, said combination data connector element having a combination of pins disposed in the combination data connector element for two data transmission protocols s;

the combination data connector element formed to accept a single insert element having a combination of pins for two data transmission protocols.

11. The information handling device of claim 10, wherein the two data transmission protocols comprise Displayport and USB.

12. The information handling device of claim 10, wherein the combination data connector element further comprises a post element.

13. The information handling device of claim 12, wherein the power connector element is disposed adjacent to an end of the combination data connector element where the post element is situated.

14. The information handling device of claim 10, wherein the combination of pins for two data transmission protocols comprise:

first side of pins for a first data transmission protocol; and second side of pins for a second data transmission protocol.

15. The information handling device of claim 14, wherein the first side of pins comprise USB pins.

16. The information handling device of claim 15, wherein the first side of pins further comprise one or more power pins.

17. The information handling device of claim 16, wherein the one or more power pins is other than the dedicated power connector element.

18. The information handling device of claim 14, wherein the second side of pins comprise DisplayPort pins.

19. An insertion element, comprising:

a dedicated power-insertion element; and a combination data-insertion element separate from said dedicated power-insertion element, said combination data-insertion element having a combination of pins disposed in the combination data-insertion element for two data transmission protocols;

the combination data-insertion element formed to accept a single connector element having a combination of pins for two data transmission protocols.

20. The insertion element of claim 19, wherein the two data transmission protocols comprise Displayport and USB.

* * * * *